United States Patent [19]

Takeshima et al.

[11] Patent Number: 4,538,666

[45] Date of Patent: Sep. 3, 1985

[54] GAS VENTING ARRANGEMENT INCORPORATED INTO A MOLD

[75] Inventors: Takahiko Takeshima; Haruo Akemoto; Hideki Iwai, all of Ube, Japan

[73] Assignee: UBE Industries, Ltd., Ube, Japan

[21] Appl. No.: 549,822

[22] Filed: Nov. 8, 1983

[30] Foreign Application Priority Data

Nov. 9, 1982 [JP] Japan ..... 57-195319

[51] Int. Cl.[3] ..... B22D 17/20

[52] U.S. Cl. ..... 164/305; 164/410; 425/420; 425/812

[58] Field of Search ..... 425/812, 420; 249/141; 164/305, 410

[56] References Cited

U.S. PATENT DOCUMENTS

| | | | |
|---|---|---|---|
| 2,867,869 | 1/1959 | Hodler | 164/305 X |
| 2,971,230 | 2/1961 | Coleman et al. | 164/305 |
| 3,349,833 | 10/1967 | Hodler | 164/305 X |
| 3,433,291 | 3/1969 | Hodler | 164/305 |
| 3,885,618 | 5/1975 | Hodler | 164/305 |
| 3,892,508 | 7/1975 | Hodler | 164/305 X |
| 4,027,726 | 6/1977 | Hodler | 164/305 |
| 4,239,080 | 12/1980 | Hodler | 164/305 |
| 4,431,047 | 2/1984 | Takeshima et al. | 164/305 X |
| 4,489,771 | 12/1984 | Takeshima et al. | 164/305 |

FOREIGN PATENT DOCUMENTS

| | | | |
|---|---|---|---|
| 57-88960 | 6/1982 | Japan | 164/305 |

*Primary Examiner*—Nicholas P. Godici
*Assistant Examiner*—J. Reed Batten, Jr.
*Attorney, Agent, or Firm*—Finnegan, Henderson, Farabow, Garrett & Dunner

[57] ABSTRACT

A gas venting arrangement incorporated into a mold for use in a die casting or injection mold machine, having a passage for venting gases including by-pass passages and a valve chamber consisting of a forward portion formed in the mold where the valve is slidably received and a rear portion formed by a member separate from the mold. The valve and the passage are designed so that the valve is forced to move from an opened position to a closed position to shut the passage upon axial impingement of a melt from a cavity of the mold. The arrangement has a first system for biasing the valve into the opened position, a second system for biasing the valve into the opened position upon the melt impingement, and a system for releasing the valve from the second biasing means to return from the opened position to the closed position. There is provided a piston-cylinder device, in which the valve and the rear portion of the valve chamber form the piston and the cylinder, respectively, which device provides the first releasing system when the piston is actuated to move forward and second system for releasing the valve from the first biasing system to move from the closed position to the open position when the piston is actuated to move rearward.

11 Claims, 3 Drawing Figures

GAS VENTING ARRANGEMENT INCORPORATED INTO A MOLD

BACKGROUND OF THE INVENTION

1. Field of the Invention

The present invention relates to a gas venting arrangement incorporated into a mold for use in a die casting machine or other molding machine, more particularly to an improvement of the gas venting arrangement of the axial melt impinging type, disclosed in Australian Pat. No. 516,938 and U.S. Pat. No. 4,431,047 issued Feb. 14, 1984.

2. Description of the Prior Art

The die casting method is widely used for manufacturing large quantities of precision products. Since molten metal is charged at a high speed under a high pressure into the mold cavity, however, gases are not sufficiently vented from the mold cavity, resulting in voids in the final product. This method therefore is often unsuitable for preparing high quality products for which the absence of voids is required.

To overcome this disadvantage, an improved gas venting arrangement as disclosed in the above-mentioned patents was invented. In this arrangement, a large quantity of gas can be easily and reliably vented irrespective of the kind of cast product or mold, and a high quality die cast product free of entrained gas can be obtained.

According to the disclosed arrangement, when the melt is injected, a discharge passage extending from the cavity of the mold to the outside of the mold is opened by valve action. When the gas in the cavity is completely discharged through the discharge passage, the inertia force of the injected melt, which has advanced from the interior of the cavity, is directly imposed on the valve, that is, the melt strikes the valve. This assuredly and promptly moves and closes the valve to shut the discharge passage and prevent flow-out of the melt through the discharge passage.

It was found, however, that, when the melt which is supposed to strike the valve flows discontinuously, it does not always close the valve completely and assuredly. When the leading portion of the discontinuous melt initially strikes the valve, it may move the valve upward against the downward force of a spring provided in the arrangement to change the valve from the opened position to the closed position. After the leading portion, however, the valve is returned to the opened position by the downward force of the spring until the following portion of the melt reaches the valve.

Under such circumstances, when the following portion of the melt approaches the valve, the leading portion is already solidifying at the front face of the valve and adhering to the valve face and inner wall of the discharge passage near the valve. As a result, the impinging force of the following portion of the melt against the valve is considerably reduced. This prevents the valve from returning smoothly to the closed position and results in incomplete valve closure and axial valve oscillation during the discontinuous impingement.

The first mentioned gas venting arrangement was improved to overcome the above defects and patent applications were filed for this improvement in Japan, the U.S. (Ser. No. 322,264 filed Nov. 17, 1981 and now U.S. Pat. No. 4,489,771 issued Dec. 25, 1984), and several other countries. As disclosed in the Japanese unexamined publication (No. 57-88962) of the application, the improved invention provides the following gas venting arrangement incorporated into a mold formed of stationary and movable mold halves together defining a cavity to be filled with a melt. The arrangement comprises:

(a) a valve chamber including an enlarged forward portion formed in the mold and a constricted rear portion formed in a member separate from the mold, and a valve seat formed between the forward and rear portions;

(b) a gas vent passage formed in the mold connected to the cavity and to the forward end of the forward portion of the valve chamber;

(c) a gas discharge passage formed in the mold and opening on an inner side surface of the rear portion of the valve chamber to communicate with the outside of the mold;

(d) at least one by-pass passage formed in the mold branching from a point on the gas vent passage to an opening on an inner side surface of the forward portion of the valve chamber;

(e) a valve slidably received in the forward portion of the valve chamber for movement between a first position, wherein the valve cooperates with the valve chamber to prevent the gas vent passage from communicating with the gas discharge passage through the forward portion of the valve chamber and to permit the by-pass passage to communicate therewith through the valve chamber, and a second position, wherein the valve rests against the valve seat and cooperates with the valve chamber to prevent both the by-pass passage and the gas vent passage from communicating with the gas discharge passage through the valve chamber;

(f) first means for biasing the valve into the first position and permitting movement of the valve into the second position under axial impingement against the valve of a portion of the melt injected into the cavity and forced to flow through the gas vent passage into the forward portion of the valve chamber, the first biasing means being adjusted and the by-pass passage being dimensioned and configured to permit movement of the valve into the second position before a second portion of the melt reaches the forward portion of the valve chamber through the by-pass passage;

(g) second means for biasing the valve into the second position after the valve is forced to move from the first position to the second position by an initial impingement of the melt; and (h) means for releasing the valve from the second biasing means to return from the second position to the first position.

The embodiment of the above arrangement as disclosed comprises a spool forming the rear portion of the valve chamber and a piston-cylinder apparatus. The spool is connected to the piston, so that it can be moved in the axial direction of the valve extension by actuation of the piston. The valve extension is connected to the spool by means of a spring and thus it is forced to move rearward according to the rearward movement of the spool. The above-mentioned releasing means is a stopper mechanism for stopping the rearward movement of the valve relative to the spool while the spool is forced to move rearward. The above-mentioned first biasing means is a retention mechanism for retaining the valve in the first position when the stopper mechanism functions. The stopper mechanism includes opposite arms radially extending from the valve extension and stopping means provided on the spool or another member for the arms. The retention mechanism includes an elastic or spring member to be engaged with a specific portion of the valve extension.

Such an embodiment, however, is complicated, and the height of the arrangement is inevitably large.

Further, as the mold is cold at the start of injection of the melt, the melt tends to solidify before it arrives at corners of the mold cavity, resulting in an incomplete molded product. Therefore, several shots of melt are normally injected at a low speed to warm the mold before ordinary or normal injection is carried out. If the above arrangement is directly applied to a process in which the injection speed is low in the initial stage and is only later increased, there is the disadvantage that the weak inertia force of the initial melt will not close the valve enough, creating the risk of intrusion of the melt into the valve chamber. If the melt intrudes into the valve chamber, it will solidify there and obstruct the gas venting arrangement, necessitating repair or replacement of the arrangement. Repair or replacement, of course, will force a stop of the molding operation and reduce productivity.

Now, the previous arrangement was designed so that, when the mold is opened, the entire spool, that is, the removable rear portion of the valve chamber, is raised; the retreating movement of the valve is stopped midway of the retreating or rearward movement of the spool; and the valve is biased into the first or opened position by the stopper mechanism and so that, when the mold is closed, the spool is brought down to a predetermined position with the valve open in the first position. At the start of actuation of the piston, however, the pressure of the hydraulic fluid acts abruptly and creates a shock. As a result, a force is imposed on the valve exceeding the retention capacity of the mechanism for retaining the valve in the first position, thus forcing the valve into the second position. This prevents the gas venting arrangement from functioning.

SUMMARY OF THE INVENTION

A primary object of the present invention is to eliminate or overcome the above-mentioned defects of the conventional gas venting arrangement incorporated into a mold.

According to the present invention, there is provided a gas venting arrangement incorporated into a mold featuring the elements (a) to (h) described in the "Background of the Invention", having the following improvements:

(A) The gas venting arrangement comprises a pneumatic piston-cylinder device such that the rear portion of the valve chamber has a closed rear end and extends rearward to form the cylinder at its rear end portion. The valve has a rearward extension co-axial with the valve chamber extension and extending slidably thereinto. The valve extension forms the piston.

(B) The first biasing means releasably secures the valve in the first position to the rear portion of the valve chamber or to the valve chamber extension against the force of the second biasing means.

(C) The second biasing means constantly urges the piston rearward relative to the rear portion of the valve chamber.

(D) The piston-cylinder device functions as the releasing means in such manner that the device actuates the piston to move forward against the force of the second biasing means.

(E) The piston-cylinder device further functions as second means for releasing the valve from the first biasing means to move from the first position to the second position in such a manner that the device actuates the piston to move rearward against the force of the first biasing means.

BRIEF DESCRIPTION OF THE DRAWINGS

Other features and advantages of the present invention will be more fully understood from the following detailed description with reference to the accompanying drawings, in which.

DESCRIPTION OF THE PREFERRED EMBODIMENTS

Figure 1:
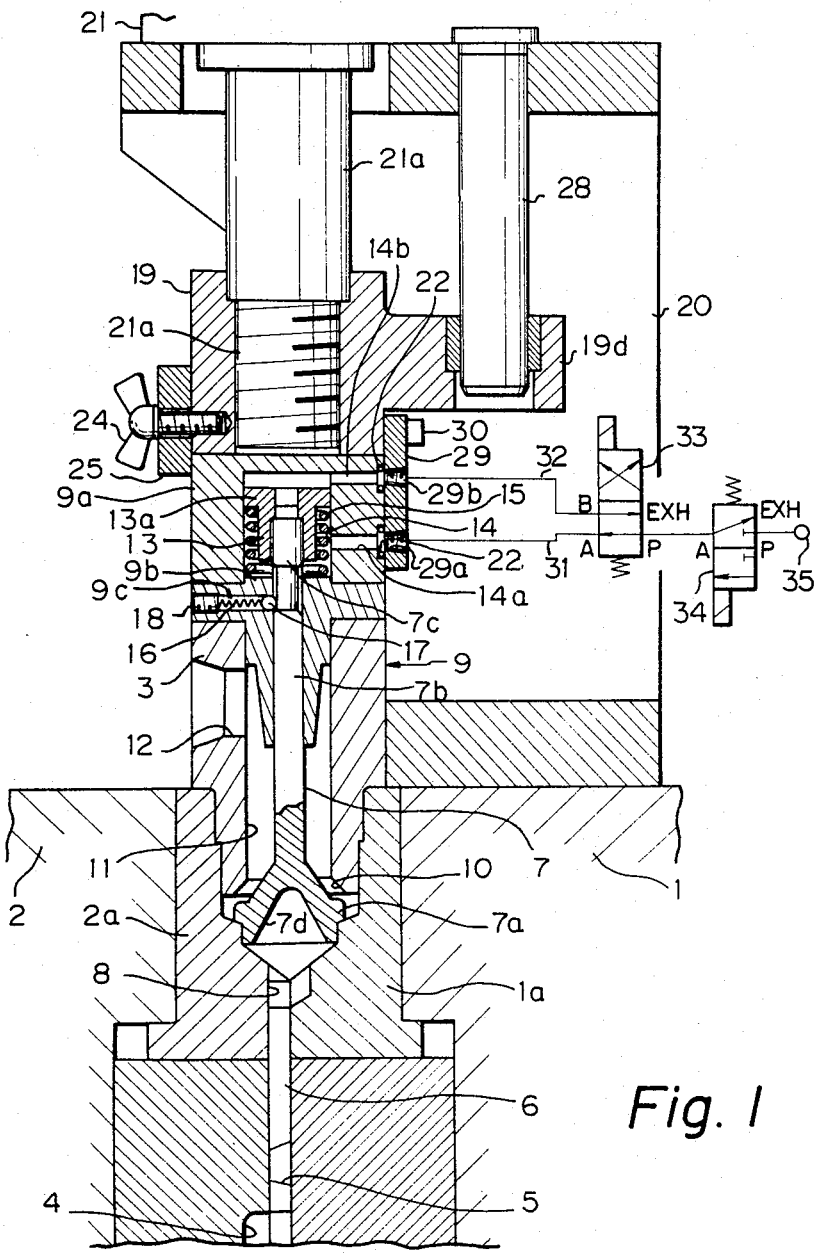
FIG. 1 is a front sectional view of a first embodiment of the present invention.
Figure 2:
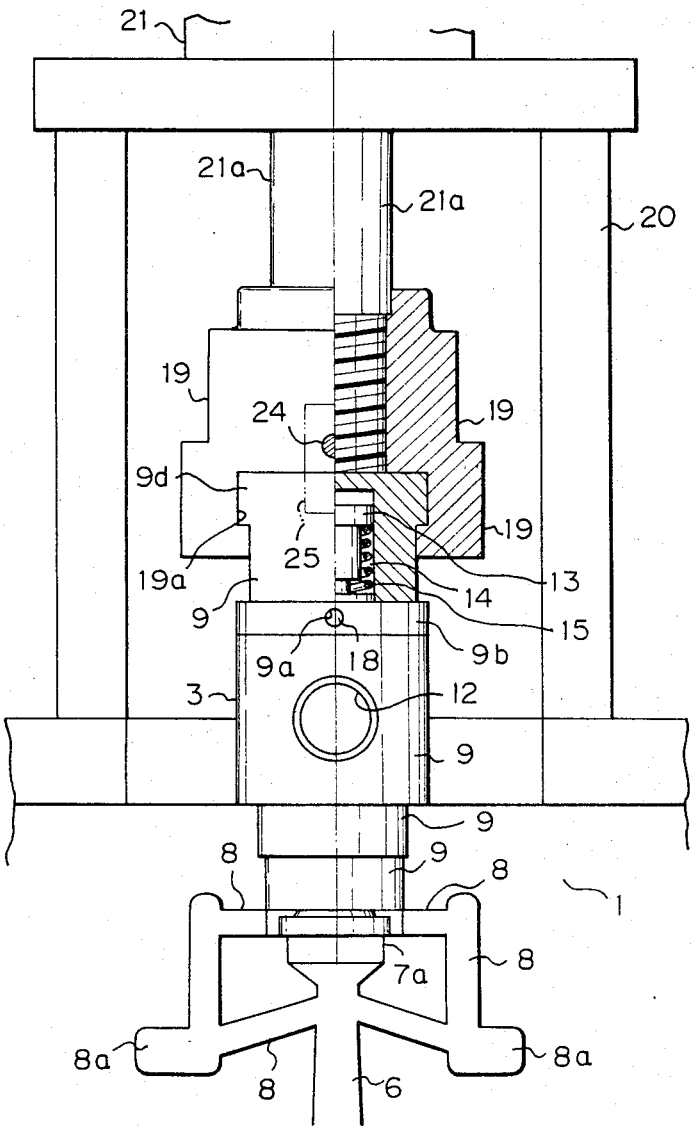
FIG. 2 is a partially sectional side view of the first embodiment.

In FIGS. 1 and 2, a mold detachably secured to a die casting machine has stationary and movable mold halves 1 and 2 which, in combination, define a cavity 4 therein. The mold has seat members 1*a* and 2*a* mounted on the stationary and movable mold halves 1 and 2, respectively, as integrated parts thereof. A gas venting arrangement 3 is provided along the parting faces of the mold halves 1 and 2 and the extensions of the seat members 1*a* and 2*a*.

A gas passage extends from a gas vent passage 5 formed on the parting face of the mold along the periphery of the cavity 4 to the lower part of the gas venting arrangement 3 through gas venting grooves 6.

In the gas venting arrangement 3, a valve 7 having a valve head 7*a* and a valve extension or rod 7*b* are provided. The gas vent groove 6 is substantially perpendicular to the lower face of the valve head 7*a*. A gas discharge passage 8 including two by-pass passages detouring in the lateral direction of the valve head 7*a* from midway of the gas vent groove 6 and extending to the upper side portion of the valve head 7*a* is formed. Reference numeral 8*a* represents a melt reservoir formed in the mold.

The gas venting arrangement 3 has a valve chamber 11 consisting of a small front portion formed in the mold and a large rear portion formed in a spool 9, which is a hollow member separate from the mold. When the spool 9 comes into contact with the mold to form the valve chamber 11, a valve seat 10 is located between the front and rear portions of the valve chamber 11. The valve head 7*a* is slidably received in the front portion of the valve chamber 11, while the valve extension 7*b* slidably extends into the rear portion of the valve chamber 11, i.e., the spool 9. When the valve head 7*a* is forced to move upward (in FIGS. 1 and 2) in the axial direction of the valve, it comes into contact with the valve seat 10 and closes the communication of the passage 8 with the spool 9.

The spool 9 has a gas discharge outlet 12 which thus opens to the rear portion of the valve chamber 11.

The valve rod 7*b* forms a piston 13 at its rear end portion. The piston 13 has an enlarged end forming a piston flange 13*a*. A compressed axial coil spring 15 encircles the piston 13. The spool 9 has a guiding member 9*b* having a bore. The valve rod 7*b* slidably extends through the bore of the guiding member 9*b*. The coil spring 15 is received between the guiding member 9b and the piston flange 13a, so that the valve 7 is always subjected to a valve-closing force by the spring.

The spool 9 has a closed rear end. A cylinder 9a having a room 14 for actuating the piston 13 is defined by the guiding member 9b and the side wall of the rear end portion and the rear end of the spool 9. The cylinder 9a has lower and higher holes 14a and 14b forming pneumatic passages for feeding compressed air from an outside source 35 and discharging it from the cylinder 9a. The piston flange is fitted in the cylinder 9a and is permitted to move slidably in the cylinder 9a between the lower hole 14a and the upper hole 14b. The cylinder room 14 is divided into a lower room and an upper room by the piston flange 13a. In the above arrangement, the spool 9 and the valve rod 7b form a pneumatic piston-cylinder device.

The guiding member 9b has a recess 9c radially extending from its bore. The recess 9c is defined by a through hole and an adjusting screw 18 disposed therein from the outside of the spool 9. A steel ball 17 and a compressed radial coil spring 16 are received in the recess 9c. The ball 17 is slidable and rotatable in the recess 9c. The valve rod 7b has a forward portion and a rear portion forming the piston 13 and a constricted intermediate portion or a smaller diameter portion 7c therebetween. The steel ball 17 is urged by the radial spring 16 against the surface of the valve rod 7b, so that it is engaged with the constricted portion 7c of the valve rod and with the spool 9 at the recess 9c. The ball, in combination with the radial spring 16 and the constricted portion 7c, is adapted to stop the valve 7 against the force of the axial spring 15 in the cylinder 13. Therefore, the radial spring 16 is designed so that the holding force of the radial spring 16 applied to the valve rod 7b is greater than the urging force of the axial spring 15 applied to the valve rod 7b. The spool 9 has a top end portion 9d of a rectangular configuration, which is of a T-shaped form in an axial sectional view.

Reference numeral 19 represents a rectangular block having front and back faces and a T-shaped groove 19a therebetween, corresponding to the above-mentioned T-shaped top end portion 9d of the spool 9. The spool 9 is connected to the block 19 by having the T-shaped top end portion 9d disposed in the T-shaped groove 19a. The block 19 has a front blocking plate 25 and a back blocking plate 29, which are secured to its front and back faces by a butterfly screw 24 and a bolt 30, respectively.

The front blocking plate 25 is designed so as to be a rotary lever pivoted on the front face of the block. When this plate 25 is in the vertical state, its lower end comes into contact with the front face of the top end portion of the spool 9. Thus, in this case, the spool 9 is not prevented from detaching from the T-shaped groove 19a. When the plate 25 is in the horizontal state, the spool 9 is removable from the block.

The back blocking plate 29 has pneumatic passages 29a and 29b to communicate with the corresponding lower and upper pneumatic passages 14a and 14b. O-rings 22 are attached to the positions where the corresponding passages of the cylinder 13 and back blocking plate 29 are connected, so that an air seal effect for sealing the two pneumatic passage lines from each other is obtained.

The lower or forward pneumatic passage line including the lower or forward passages 14a and 29a is connected to the compressed air source 35 through a pipe 31 and ports A of solenoid valves 33 and 34, while the upper or rear pneumatic passage line including the upper or rear passages 14b and 29b is connected to port B of the valve 33 through a pipe 32.

The gas venting arrangement is provided with a hydraulic or pneumatic piston-cylinder apparatus comprising a cylinder 21, secured to a supporting frame 20 which is mounted on the stationary mold half 1, and a piston rod 21a. The piston rod 21a is secured to the block 19 at its lower end. The block 19 has a guiding arm 19d extending horizontally from the back side of the block. The arm 19d has a vertical hole where a guiding rod 28 mounted on the side of the supporting frame 20 is disposed slidably. The arm 19d exerts a guiding action when the spool 9 is raised up or brought down, as described hereinafter.

When the plate 29 is adopted as shown in FIGS. 1 and 2, it is possible to easily take out only the spool 9 and/or the valve 7 at the time of cleaning the gas vent arrangement. In this case, the plate 29 is left as it is, while the plate 25 is turned to open the T-shaped groove 9d at the front side of the block, and the pipes 31 and 32 connected to the compressed air source 35 are left on the side of the block 19, as they are. Accordingly, the pipes need not be removed or dismounted, and the cleaning or maintenance operation can be greatly facilitated. Of course, attachment of the spool 9 to the piston rod 21a by means of the block 19 can easily be accomplished by inserting the T-shape top and portion 9d of the spool 9 into the corresponding T-shaped groove 19a of the block with the plate 29 closing the groove at the back side of the block and then by locking the spool 9 by the plate 25.

The operation of the embodiment having the above-mentioned structure will now be described. At the time of the start of the injection, the solenoid valve 34 is turned on in the state where the spool 9 is moved upward from the mold, and a pneumatic pressure is applied into the forward or lower room in the cylinder 13, from the air source 35 through the solenoid valve 33. At this point, the pressure on the lower room is increased, and the valve 7 is forced to move up against the urging force of the radial spring 16, and the valve 7 is seated on the valve seat 10 to close the lower end opening of the spool 9. In this case, since the air pressure in the upper room is released to the exhaust port of the solenoid valve 33, the elevation of the valve 7 relative to the spool 9 can be performed smoothly. The axial spring 15 does not obstruct the elevation of the valve 7.

In the above state, the cylinder 21 is actuated to bring down the entire spool 9. If the stationary and movable mold halves 1 and 2 are clamped in this state, low speed injection can be performed while the valve 7 is closed. The inertia force of the melt is small at the time of the low speed injection, but since the valve 7 is closed or in the closed or second position in advance, the melt is not allowed to flow into the valve chamber 11.

Several shots of injection are thus carried out until the mold is warmed. After the mold is warmed, the low speed injection and high speed injection are carried out in combination. Since the melt has reached the level for a large inertia force at this injection operation, the valve-closing force is sufficient.

It is then necessary to prevent the valve 7 from being closed by the shock which occurs when the spool 9 is brought down to the mold. In this case, the solenoid valves 33 and 34 are turned on. Accordingly, the pneumatic pressure is applied to the upper room of the cylinder 13. By the pressure, the valve 7 is brought down against the force of the compressed axial spring 15 in the cylinder 13 relative to the spool 9. Thus, the valve 7 is kept in the open position. Accordingly, when the cylinder 21 is actuated to bring down the spool 9, even if shock occurs, the valve 7 is not closed. With lowering of the valve 7, the steel ball 17 is engaged with the constricted portion 7c to maintain the open or first position of the valve 7.

Subsequently, in the first or opened position, the steel ball 17 is pressed to the stepped part of the lower end of the constricted portion 7c of the valve rod 7b. In the state where the valve head 7a is separated from the valve seat 10, that is, where the valve 7 is opened, the entire spool 9 is brought down by actuating the cylinder 21. After the spool 9 is brought down, the solenoid valves 33 and 34 are turned off.

When the stationary and movable mold halves 1 and 2 are clamped in this state, a passage extending from the cavity 4 to the outside of the spool 9 through the gas vent passage 5, the gas vent groove 6, the passage 8, and the valve chamber 11 is formed. In this opened state, an injection plunger (not shown) is actuated to supply molten metal into the cavity 4. At this point, the melt filled in the cavity 4 is advanced through the gas vent passage 5 and the gas vent groove 6, while the gas generated in the cavity is guided toward the discharge outlet 12 of the spool 9 through the passage 8 and the valve chamber 11. Since the gas has a small mass, the valve 7 is not closed by the action of the gas.

Subsequent to the gas, the melt impinges against the lower end face of the valve head 7a. Since the mass of the melt or the molten metal is much larger than that of the gas, the inertia force of the melt is larger. The impingement given to the valve 7 by the melt at this time is much larger than that given to the valve 7 by the gas. Thus, the valve 7 springs up. Accordingly, the valve 7 is set free from the restricting or holding force of the steel ball 17 pressed or urged by the compressed radial spring 16, and the valve 7 is directed upward, while the pull-up force of the compressed axial spring 15 in the cylinder 13 is added. As a result, the upper face of the valve head 7a comes into contact with the valve seat 10 to shut the communication between the passage 8 and the spool 9 and, thus, the melt is stopped at the position of the valve 7. At this point, even if the melt is mixed with the gas in the gas vent passage 5 and the gas vent groove 6 and is splashed to impinge discontinuously on the valve head 7a, the valve 7 is ensured to spring up by the first or initial impingement of the melt. Even if the upward pressing force of the melt is then lost because of the subsequent gas, closing of the gas discharge passage by the valve 7 is accomplished assuredly. This is because an upward sliding tendency relative to the spool 9 is given to the valve 7 by the compressed axial spring 15.

As is apparent from FIG. 1, a very deep concave portion 7d is formed on the lower face of the valve head 7a. Therefore, substantially all of the melt or metal powder impinges against this concave portion 7d. Hence, escape of the molten metal or the like above the valve head 7a through the periphery of the valve 7 is not caused and the valve head 7a is assuredly located at the valve seat 10.

The injection is thus carried out, and the casting operation is conducted for a predetermined time by cooling under pressure in the state where the valve 7 is closed. Then, the mold is opened and the cylinder 21 is actuated to raise the piston 21a together with the spool 9. With this elevation of the spool 9, the solidified metal filled in the cavity 4, the gas vent passage 5, the gas vent groove 6, and the passage 8 is separated from the valve 7. The resultant molded or cast article is taken out from the movable mold half 2 by a product push-out device (not shown).

When the cylinder 21 is actuated to raise the entire spool 9, as described hereinbefore, pneumatic pressure is imposed on the piston flange 13a, whereby this piston flange or piston is brought down against the force of the axial spring 15 to open the valve 7. At this stage, the valve head 7a and the valve seat 10 can be cleaned by compressed air.

When it is desired to clean or check the entire gas venting arrangement, the butterfly screw 24 is loosened and the plate 25 is turned by about 90° to a horizontal position. The T-shaped top end portion 9d of the spool 9 can then be easily removed from the T-shaped groove 19a, and thus the entire spool 9 can be dismounted very easily.

In the present embodiment having the above-mentioned structure, no mechanical stopper mechanism as adopted in the conventional apparatus need be used at all, and the opening and closing of the valve can be accomplished by remote control using pneumatic pressure. Accordingly, the structure of the gas venting arrangement can be made compact, and the valve can be opened and closed without dangerous manual operation by a worker.

Figure 3:
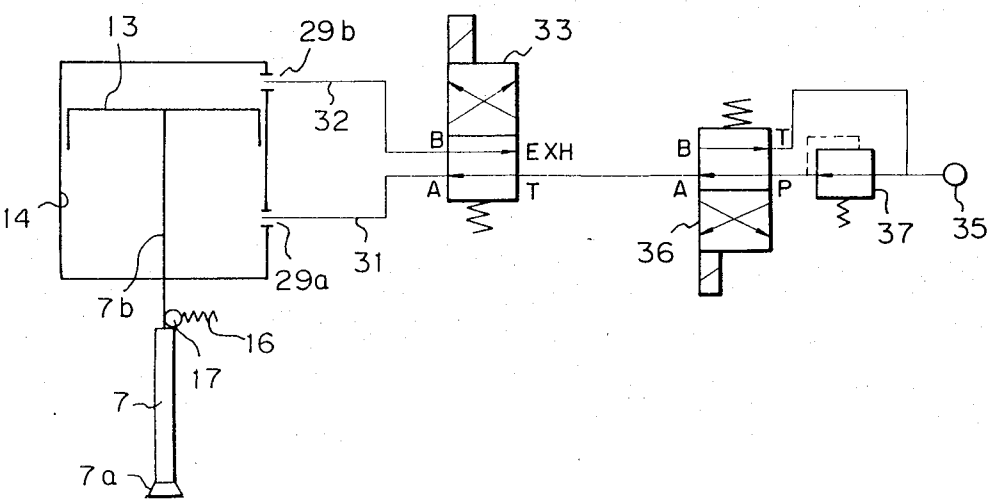
FIG. 3 is a diagram of a second embodiment of the present invention, mainly showing a pneumatic piston-cylinder system.

FIG. 3 illustrates another embodiment of the present invention, but is simplified by omitting the common members and portions except those necessary for the illustration of the invention.

In this embodiment, the axial spring 15 adopted, as shown in FIGS. 1 and 2, to urge the piston 13a upward relative to the spool 9 is not adopted. Instead, the solenoid valve 33 is connected to the pneumatic passages 29a and 29b through the pipes 31 and 32. An additional solenoid valve 36 and a pressure reducing valve 37 are provided between the valve 33 and the air source 35 so that the valve 36 is located at a point closer to the valve 33 than the pressure reducing valve 37.

In this embodiment, at the low speed injection conducted in the initial stage, if the solenoid valves 33 and 36 are turned off, the pressure is reduced to a predetermined level by the pressure reducing valve 37, and the pneumatic pressure is applied to the lower room of the cylinder 13. If such pneumatic pressure is set at a level slightly lower then the holding force exerted by the steel ball 17 with the radial spring 16, the valve 7 is kept in the first or opened position. The upward force by the low pneumatic pressure is imposed on the valve 7, and the valve 7 is thus prevented from being opened after it has been closed. More specifically, the pneumatic pressure generated through the pressure reducing valve 37 has the function of the axial spring 15 adopted in the first embodiment in FIGS. 1 and 2.

In the present second embodiment, when the inertia force of the melt is imposed on the valve 7, the valve 7 is assuredly closed.

When the solenoid valve 36 is turned on, the piston flange 13 is forcibly pushed up by the pressure of the compressed air source 35, and the valve 7 is closed against the holding force of the steel ball 17 with the radial spring 16. When the gas venting arrangement is set to the mold in the state where the valve 7 is thus closed by the pneumatic pressure and trial shots are carried out for the low speed injection at the initial stage of operation, even if the inertia force of the melt is too small to close the valve 7, escape of the melt toward the valve chamber 11 is not caused.

When the mold is warmed and ordinary injection molding is carried out by performing high speed injection and low speed injection in combination, and if the solenoid valves 33 and 36 are turned on in the state where the spool 9 is elevated by actuation of the cylinder 21 and the mold is opened, the pressure of the air source 35 is imposed on the piston 13 through the upper room of the cylinder 9*a*, and the valve 7 is forcibly opened. Accordingly, undesirable closing of the valve 7 due to shock given when the spool 9 is brought down by actuation of the cylinder 21 is prevented.

Since the present embodiment has the above-mentioned structure, the same effects as attained in the preceding embodiment are also attained. Further, no compressed axial spring 15 need be provided, the number of parts is reduced, and assembly of the gas venting arrangement is facilitated.

As is apparent from the foregoing description, according to the present invention, the valve for gas venting is forcibly opened and closed by pneumatic pressure, and remote control is possible to open and close the gas venting valve. Accordingly, no mechanical stopper means as used in the conventional apparatus for opening the valve need be provided, and thus the structure of the gas venting arrangement is simplified.

Furthermore, since it is not necessary for a worker to perform a manual operation for opening and closing the gas venting valve, the opening and closing operation can be accomplished assuredly without any trouble or danger.

Since it is not necessary to provide the gas venting valve with a lever or the like for use in the stopper mechanism, the mass of the valve can be reduced and the inertia force of the valve can be reduced accordingly. Accordingly, the response characteristic of the valve to the opening and closing operations can be highly improved.

Moreover, since the gas venting valve forms the piston for use in a piston-cylinder device at its upper end portion, and the pneumatic pressure is applied to the front face of the piston, the valve can be closed by remote control at the time of trial shots at the start of the molding operation. Therefore, accidents in which the valve is not closed at the low speed injection and the melt intrudes into the valve chamber are prevented, and therefore no forcible shutting of the passage for preventing the melt from escaping into the valve chamber need be performed.

In addition, since the pneumatic pressure is applied to the rear face of the piston formed by the valve, even if shock is produced when the spool is brought down, the valve is not closed, and it is possible to bring down the spool in the state where the valve is opened and to maintain a normal gas venting function in this state.

We claim:

1. In a gas venting arrangement incorporated into a mold formed of stationary and movable mold halves together defining a cavity to be filled with a melt, said gas venting arrangement comprising:

(a) a valve chamber including an enlarged forward portion formed in said mold and a constricted rear portion formed in a member separate from said mold, and a valve seat formed between said forward and rear portions;

(b) a gas vent passage formed in said mold connected to said cavity and to the forward end of said forward portion of said valve chamber;

(c) a gas discharge passage formed in said mold and opening on an inner side surface of said rear portion of said valve chamber to communicate with the outside of said mold;

(d) at least one by-pass passage formed in said mold branching from a point on said gas vent passage to an opening on an inner side surface of said forward portion of said valve chamber;

(e) a valve slidably received in said forward portion of said valve chamber for movement between a first position, wherein said valve cooperates with said valve chamber to prevent said gas vent passage from communicating with said gas discharge passage through said forward portion of said valve chamber and to permit said by-pass passage to communicate therewith through said valve chamber, and a second position, wherein said valve rests against said valve seat and cooperates with said valve chamber to prevent both said by-pass passage and said gas vent passage from communicating with said gas discharge passage through said valve chamber;

(f) first means for biasing said valve into said first position and permitting movement of said valve into said second position under axial impingement against said valve of a portion of said melt injected into said cavity and forced to flow through said gas vent passage into said forward portion of said valve chamber, said first biasing means being adjusted and said by-pass passage being dimensioned and configured to permit movement of said valve into said second position before a second portion of said melt reaches said forward portion of said valve chamber through said by-pass passage;

(g) second means for biasing said valve into said second position after said valve is forced to move from said first position to said second position by an initial impingement of said melt; and (h) first means for releasing said valve from said second biasing means to return from said second position to said first position, the improvement consisting in that:

(A) said gas venting arrangement comprises a pneumatic piston-cylinder device in such arrangement that said rear portion of said valve chamber has a closed rear end and extends rearward to form said cylinder at its rear end portion, and said valve has a rearward extension co-axially therewith and extending slidably thereinto, said valve extension forming said piston at its rear end portion;

(B) said first biasing means is that for releasably securing said valve in said first position to said rear portion of said valve chamber against the force of said second biasing means;

(C) said second biasing means is that for constantly urging said piston rearward relative to said rear portion of said valve chamber;

(D) said piston-cylinder device functions as said first releasing means in such manner that said device actuates said piston to move forward against the force of said second biasing means; and (E) said piston-cylinder device further functions as second means for releasing said valve from said first biasing means to move from said first position to said second position in such manner that said device actuates said piston to move rearward against the force of said first biasing means.

2. A gas venting arrangement incorporated into a mold, as claimed in claim 1, wherein said piston-cylinder device has means for actuating said piston in operational manners of two stages where said piston is subjected to lower and higher operation pressures at its forward pressured face, respectively, said piston-cylinder device functioning as said second biasing means when it is actuated to apply the lower operation pressure, while it functions as said second releasing means when it is actuated to apply the higher operation pressure.

3. A gas venting arrangement incorporated into a mold, as claimed in claim 2, wherein said second releasing means is actuated in the initial operation stage where the mold is not warmed enough and the injection speed is too low to fill said mold with the injected melt and thus to have the part of said melt impinge against said valve.

4. A gas venting arrangement incorporated into a mold, as claimed in any one of claims 1 to 3, wherein said piston-cylinder device functions as means for reinforcing said first biasing means to prevent said valve from moving toward said second position during the forward movement of said rear portion of said valve chamber, in such manner that said first piston is subjected to the operation pressure at its rear pressured face during said forward movement.

5. A gas venting arrangement incorporated into a mold, as claimed in any one of claim 1 and 2, wherein the valve chamber extension has a guiding member integrally mounted therein, which member divides its inner space into a forward portion having said opening of said gas discharge passage and a rear portion forming said cylinder, said guiding means having a bore through which said valve extension extends slidably; said piston has a radially extending flange at its rear end portion, which flange is slidably fitted to the inner surface of said cylinder; said cylinder has two pneumatic passages, for feeding and discharging pneumatic medium, open to the inner surface of said cylinder in forward and rear positions between which said piston flange is permitted to move.

6. A gas venting arrangement incorporated into a mold, as claimed in claim 3, wherein: said valve extension has a forward portion, a rear portion forming said piston, and a constricted portion therebetween; said valve chamber extension has a recess formed on the inner surface of said bore of said guiding member and extending radially outward, a compressed radial coil spring and a rotatable ball being received slidably in said radial recess so that said radial spring biases said ball against the surface of said valve extension and said ball is engaged with said valve chamber extension at said recess thereof and with said valve extension at said constricted portion thereof, said first biasing means comprising said radial spring, said ball, said recess of said guiding means, and said constricted portion of said valve extension.

7. A gas venting arrangement incorporated into a mold as claimed in claim 6, wherein a compressed axial coil spring is provided in said cylinder to encircle said piston between said guiding member and said piston flange, said second biasing means comprising said axial coil spring, said guiding member, said piston, and said cylinder.

8. A gas venting arrangement incorporated into a mold, as claimed in claim 7, further comprising a second hydraulic or pneumatic cylinder mounted onto said mold for actuating a second piston coaxial with said valve chamber, said second piston being connected to the rear end of said valve chamber, whereby said separate forward and rear portions of said valve chamber are detachably connected with each other due to the actuation of said second cylinder.

9. A gas venting arrangement incorporated into a mold, as claimed in claim 8, wherein: said second cylinder has a connecting block fixed to said second piston at a forward end thereof, and said second cylinder has a guiding rod parallel to said second piston, the rear end portion of said valve chamber extension having a rectangular outer configuration of a T-shape enlarging its rear end in an axially sectional view, while said block has a groove extending in a direction perpendicular to the axis of said second piston from its front face to its back face and extending rearward from its forward end face so that said groove has a T-shaped configuration enlarging a rear bottom thereof in an axially sectional view, which corresponds to that of said rear end portion of said valve chamber extension; and front and back blocking plates are detachably connected to said block on the front and back faces thereof, respectively for preventing said valve chamber extension from being removed from said block after said rear end portion of said valve chamber extension is fitted into said block groove.

10. A gas venting arrangement incorporated into a mold, as claimed in claim 9, wherein: said rear end portion of said valve chamber extension has front and back faces, said back face having said pneumatic passages opening thereon with O-rings; said back blocking plate has two corresponding pneumatic passages, each of said O-rings being located between each pair of said pneumatic passages of said first piston and said back blocking plate for preventing said medium from flowing into the other pair of said pneumatic passages.

11. A gas venting arrangement incorporated into a mold, as claimed in claim 10, wherein said front blocking plate is a rotary lever pivoted on the front face of said block by a butterfly screw, thereby to lock said valve chamber extension in said T-shaped groove of said block, while the back blocking plate abuts against said valve chamber extension.

* * * * *